US006670760B2

(12) United States Patent
Suzuki et al.

(10) Patent No.: US 6,670,760 B2
(45) **Date of Patent: *Dec. 30, 2003**

(54) COLLECTOR STRUCTURE OF TRAVELING WAVE TUBE HAVING A LOSSY CERAMIC MEMBER

(75) Inventors: Wako Suzuki, Tokyo (JP); Takeshi Nobe, Tokyo (JP)

(73) Assignee: NEC Microwave Tube, Ltd., Kanagawa-Ken (JP)

( * ) Notice: Subject to any disclaimer, the term of this patent is extended or adjusted under 35 U.S.C. 154(b) by 92 days.

This patent is subject to a terminal disclaimer.

(21) Appl. No.: 09/849,527

(22) Filed: May 7, 2001

(65) Prior Publication Data

US 2001/0017521 A1 Aug. 30, 2001

Related U.S. Application Data

(63) Continuation of application No. 09/190,009, filed on Nov. 12, 1998, now Pat. No. 6,291,935.

(30) Foreign Application Priority Data

Nov. 14, 1997 (JP) ..... 9-331197

(51) Int. Cl.[7] ..... H01J 23/027
(52) U.S. Cl. ..... 315/5.38
(58) Field of Search ..... 315/5.38

(56) References Cited

U.S. PATENT DOCUMENTS

| | | | | |
|---|---|---|---|---|
| 3,471,739 A | | 10/1969 | Espinosa | 315/35 |
| 3,612,934 A | | 10/1971 | Henry | 315/5.38 X |
| 3,748,513 A | | 7/1973 | Levin | 313/30 |
| 6,291,935 B1 | * | 9/2001 | Suzuki et al. | 315/5.38 |

FOREIGN PATENT DOCUMENTS

| | | |
|---|---|---|
| EP | 0 258 667 | 3/1988 |
| EP | 0 412 001 | 2/1991 |
| FR | 2 268 350 | 11/1975 |
| JP | 50-137671 | 10/1975 |
| JP | 61-62338 | 4/1986 |
| JP | 2-60028 | 2/1990 |
| JP | 2-101454 | 8/1990 |
| JP | 4-306538 | 10/1992 |
| JP | 5-250998 | 9/1993 |

* cited by examiner

*Primary Examiner*—Benny T. Lee
(74) *Attorney, Agent, or Firm*—Sughrue Mion, PLLC

(57) ABSTRACT

A collector of a traveling wave tube in which a larger quantity of loss ceramic members are arranged between an outer collector enclosure and an outer surface of a collector electrode for increasing high frequency loss to prevent RF leakage from the collector lead wire. The collector includes a collector electrode 2, heat conductive columnar ceramic elements 3, an outer collector enclosure 4 for maintaining vacuum and loss ceramic members 5 arranged between the outer surface of the collector electrode 2 and the inner surface of the outer collector enclosure 4.

2 Claims, 10 Drawing Sheets

COLLECTOR STRUCTURE OF TRAVELING WAVE TUBE HAVING A LOSSY CERAMIC MEMBER

This is a Continuation Application of application Ser. No. 09/190,009 filed Nov. 12, 1998 (issued as U.S. Pat. No. 6,291,935 on Sep. 18, 2001), the disclosure of which is incorporated herein by reference.

FIELD OF THE INVENTION

This invention relates to a collector of a traveling wave tube.

BACKGROUND OF THE INVENTION

FIGS. 4, 5(*a*), 5(*b*) and 6 are longitudinal cross-sectional views of a conventional traveling wave tube. Specifically, FIG. 4 shows a conduction cooling type, FIG. 5 a forced air-cooling type and FIG. 6 shows a water-cooling type.

FIG. 7 shows a longitudinal cross-sectional view of a conventional collector, while FIG. 8*a* is a transverse cross-sectional view of another illustrative structure of a conventional collector and FIG. 8*b* is a longitudinal cross-sectional view of FIG. 8*a*. FIG. 9 shows a two-stage version of the collector shown in FIG. 8. Specifically, FIGS. 9*a* and 9*b* are a transverse cross-sectional view and a longitudinal cross-sectional view of the collector, respectively.

Among the devices which effect amplification of the micro-wave, using an electron beam, there is a traveling wave tube used as a relay station for micro-waves and for satellite communication.

Referring to FIGS. 4, 5(*a*), 5(*b*) and 6, a traveling wave tube includes an electron gun 23 for radiating an electron beam 24, a delay wave circuit 25 for producing interaction between the electron beam 24 and the input micro-wave, a collector 26 for collecting the electron beam 24 and a beam converging device 27 for converging the electron beam 24.

For increasing the efficiency of the traveling wave tube, a method known as a collector potential lowering method is used. This method consists in progressively lowering the potential applied across the collector electrode 28 (see FIG. 4) relative to the delay wave circuit 25 to lower the speed of the electron beam 24 colliding against the collector to decrease the energy generated in the collector electrode 28. To this end, there is provided a collector-insulating ceramic element 36 for maintaining insulation between the collector 26 and the delay wave circuit 25 against high voltage.

The electron beam 24 emitted by the electron gun 23 traverses the delay wave circuit 25 to amplify a signal and is collected by the collector 26. At this time, the electron beam 24 captured by the collector 26 has its kinetic energy converted into thermal energy to raise the temperature of a collector electrode 28 (see FIG. 4).

For this reason, the heat generated in the collector electrode 28 (see FIG. 4) needs to be externally released. Among the methods for releasing the heat, there are a conduction cooling type collector 31 for releasing the heat from a base plate 30 to a heat sink 29, as shown in FIG. 4, a forced air-cooling type collector 33 by providing a fin 32 on the outer periphery of the collector for flowing air thereon to release the heat with assistance from base plate 30, as shown in FIG. 5, and a water-cooling type collector 35 by providing a water-cooled pipe 34 passed through by water to release the collector heat with assistance from base plate 30, as shown in FIG. 6.

Referring to FIG. 7, the collector structure of a conventional traveling wave tube includes an insulating enclosure 37 of ceramics etc. for insulating the collector electrode 28, formed of copper, molybdenum or graphite etc., for maintaining vacuum and air-tightness, a base plate 30 for supporting the collector electrode 28 and passing heat generated in the collector electrode 28 through the insulating member to release heat to the outside and a collector-insulating ceramic element 36 for maintaining insulation against the delay wave circuit. These component parts are usually connected together by brazing or welding etc. This structure is termed an external insulation type collector 38.

In the above-described collector, there are occasions where the collector electrode is displaced in the axial direction due to mechanical vibrations or impact. This positional deviation occasionally leads to changes in the colliding position of the electron beam leading to emission of gases or leading to an increased amount of retrogressive electrons to increase the helical current of the traveling wave tube, occasionally leading to destruction of the tube bulb.

Also, in such a collector structure, a problem arises in that RE components (TEM mode) of the electron beam incident on the collector are subjected to RE leakage through a collector lead line or collector-insulating ceramic element.

In JP Patent Kokai JP-A-2-101454 (1990), there is shown a structure in which the collector electrode 28 is supported by plural heat-conductive columnar ceramic elements 40 arranged between the collector electrode 28 and the external enclosure 41 to improve vibration-resistance and resistance against impact, while maintaining voltage withstand characteristics, as shown in FIGS. 8*a* and 8*b*. This structure is termed an internal insulation type collector 39.

In this type of collector, the outer enclosure 41, collector electrode 28 and the highly heat-conductive columnar ceramic elements 40 are secured in position by deforming the outer enclosure 41 such as by press-working. If, in this structure, plural collector electrodes 28, specifically a first collector electrode 42 and a second collector electrode 43, are used and arranged in this order from the upstream to the downstream side of the electron beam, it is possible to lower the potential of the second collector electrode 43 relative to the first collector electrode 42 to improve the overall efficiency of the traveling wave tube.

A two-stage collector 44 is illustrated in FIGS. 9(*a*) and 9(*b*). An electron beam emitted by the electron gun is passed through the delay wave circuit to amplify the signal and is captured by the first collector electrode 42 and the second collector electrode 43 which are supported by heat-conductive columnar ceramic elements 40.

For improving the efficiency of the traveling wave tube, there is usually employed a method of lowering the potential of the first collector electrode 42 to approximately 50% of that of the delay wave circuit and of lowering the potential of the second collector electrode 43 to approximately one-half that of the first collector electrode 42. This method consists in sequentially lowering the collector potential with respect to the potential of the delay wave circuit to lower the speed of the electron beam impinging against the collector in order to lower the energy produced in each collector electrode while improving the overall efficiency of the traveling wave tube.

Referring to FIG. 9(*b*), in the case of a two-stage internal insulation type collector 44, it is necessary to take out a first collector lead wire 45 of the first collector electrode 42 to a position forwardly or rearwardly of the outer enclosure 41. In the present case, the collector lead wire is taken out to a position rearward of the outer enclosure 41 and is passed through the inside of an insulator tube 46 for maintaining insulation of the first collector lead wire 45 to reduce the size of the collector as shown in FIG. 9(*b*). This insulator tube 46 is led rearwardly of the collector via a groove 47 (see FIG. 9(*a*)) formed in a portion of the outer periphery of the second collector electrode 43 so as to be led to outside vacuum in an insulated state from a second collector lead line 48 (see FIG. 9(*b*)).

In this structure, the electrical field is unavoidably concentrated in an edge portion of the insulator tube 46. Since there is a corner portion of the groove 47 in this edge portion, a problem arises in that the withstand voltage is deteriorated between the first collector lead line and the ground potential.

In addition to this structure, a demand is raised in recent years for providing a small-sized lightweight structure easy to manufacture for communication or loading on a satellite to lower the cost.

SUMMARY OF THE INVENTION

The above-described collector structure of the conventional traveling wave tube is vulnerable to RF leakage from the collector lead line, such that, the RF power leakage occurs from the lead line portion if, in the case of the internal insulation type collector having a co-axial structure, impedance matching is taken between the collector lead line and the collector inlet end.

Meanwhile, in JP Patent Kokai JP-A-4-306538 (1992), for example, there is disclosed a coupling cavity type traveling wave tube in which a loss member having loss in a high-impedance area and which is designed to suppress oscillations caused by the non-continuous coupling impedance in the high impedance area is arranged in the cavity. The conventional technique of inserting this loss member is used in a high frequency circuit system (cavity 49 in FIG. 10) because the loss member 50 is of an electrically conductive material, as shown in the cross-sectional view of FIG. 10.

It is therefore an object of the present invention to provide a collector of a traveling wave tube capable of maintaining vibration-resistance, impact-resistance and voltage withstand characteristics and yet capable of suppressing or eliminating RF leakage.

For accomplishing the above object, the present invention provides a collector of an internal insulation type of a traveling wave tube having a structure in which a collector electrode is supported by a plurality of heat conductive columnar ceramic elements arranged between the collector electrode and an outer enclosure of the collector, wherein a loss ceramic member is arranged between the outer surface of the collector electrode and the inner surface of the outer enclosure of the collector.

Preferably, the loss ceramic member is cylindrically-shaped (or annular) and contacted at outer corners thereof with the outer enclosure of the collector. The loss ceramic member is contacted with the collector electrode at its inner corner diagonally opposite to the contacted portion thereof with the outer enclosure of the collector.

Preferably, the loss ceramic member(s) is (are) those on the outer peripheral surface of which is coated with a conductive layer such as graphite coating.

As for the plural heat conductive columnar ceramic elements, a number corresponding to the number of the collector electrodes less 1 of the columnar ceramic elements is designed as cylindrically-shaped ceramic elements, if the number of the collector electrodes is two or more. The cylindrically-shaped ceramic elements have a diameter equal to or less than the other heat conductive columnar ceramic elements. The cylindrically-shaped ceramic elements are arranged in an area of the collector electrode from which heat is most unlikely to be released.

Other features of the present invention are disclosed in the appended claims, the contents thereof being incorporated herein by reference thereto.

PREFERRED EMBODIMENTS OF THE INVENTION

Figure 1A:
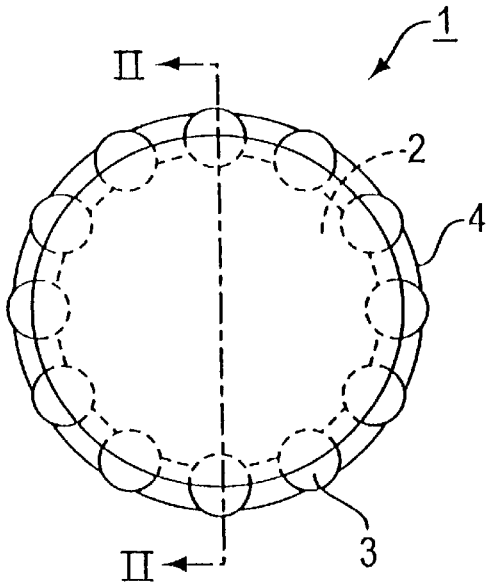
FIG. 1*a* is a transverse cross-sectional view of a collector of a traveling wave tube according to the present invention taken along line II—II of FIG. 1(*b*)

Preferred embodiments of the invention are explained further. In a preferred embodiment of the present invention, there is provided an internal insulating collector of the type in which a collector electrode (2 of FIGS. 1(*a*) and 1(*b*)) is supported by plural heat conductive columnar ceramic elements (3 of FIGS. 1(*a*) and 1(*b*)) arranged between the electrode and an outer enclosure (4 of FIGS. 1(*a*) and 1(*b*)), in which loss ceramic members displaying significant loss (high frequency loss or dielectric loss) and superior insulating properties (5 of FIG. 1(*b*)) are arranged between the outer surface of the collector electrode (surface not illuminated with an electron beam) and the inner surface of the outer enclosure of the collector (surface contacting with insulating ceramics). These loss ceramic members may be coated on their outer peripheral surface with a substance such as Aquadag (7 of FIG. 1(*b*)).

Preferably, according to a preferred embodiment of the present invention, the loss ceramic members are cylindrically-shaped (annular ring), the outer diametrical portion of each loss ceramic member contacts with the outer enclosure of the collector and the corner of the inner diametrical portion of the loss ceramic member disposed diametrically to the contacting portion contacts with the collector electrode. This realizes axial positioning of the collector while maintaining vibration-resistance and impact-resistance.

Among the plural heat conductive columnar ceramic elements, a number corresponding to the number of the collector electrodes less 1 of the columnar ceramic elements are designed as cylindrically-shaped (e.g., hollow) ceramic element(s), if the number of the collector electrodes is two or more. The cylindrically-shaped ceramic element(s) has a diameter equal to or smaller than the other heat conductive columnar ceramic elements. For improving voltage withstand characteristics, these cylindrically-shaped ceramic elements are disposed without any groove formed in the second collector (on the outer periphery thereof) for laying conventional insulating tubes as in the conventional collector. Meanwhile, the cylindrically-shaped ceramic element(s) is positioned in an area from which heat of the collector electrode is most unlikely to be released (or dissipated), for example, on the opposite side to the base plate in case of conduction cooling, towards the base plate in case of the forced air cooling, and in an area of lesser congestion of water-cooling pipes in case of forced water cooling.

With the collector of the present embodiment of the present invention, in which loss ceramic members superior in insulation properties are arranged forwardly and rearwardly of the collector for preventing RF leakage from the collector, and collector lead wire is passed through the inside of the cylindrically-shaped (hollow) heat conductive columnar ceramic elements designed for collector insulation, voltage withstand characteristics can be improved while vibration-resistance and impact-resistance equivalent to those in the conventional system are maintained, and also RF leakage may be prevented from occurring from the collector.

Embodiments

Referring to the drawings, preferred embodiments of the present invention will be explained in detail.

[First Embodiment]

Figure 1B:
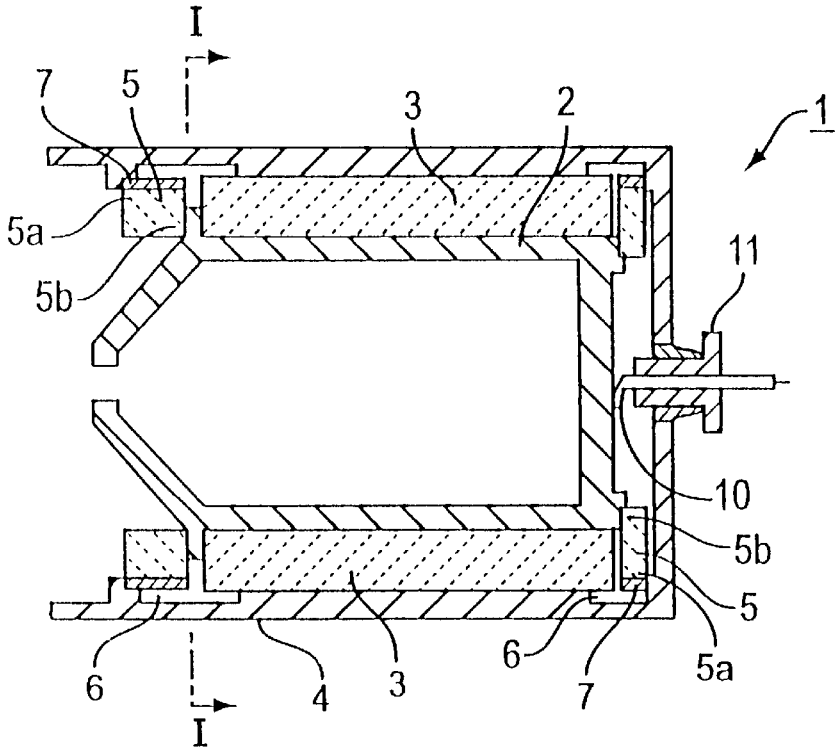
FIG. 1*b* is a longitudinal cross-sectional view taken along line I—I of FIG. 1*a*.

FIGS. 1(*a*) and 1(*b*) show a collector structure of a traveling wave tube (or guide) embodying the present invention. Specifically, FIG. 1 a is a transverse cross-sectional view of an internal insulating type collector of a traveling wave tube and FIG. 1*b* is a longitudinal cross-sectional sectional view taken along line II—II of FIG. 1*a*.

Referring to FIGS. 1(*a*) and 1(*b*), a collector 1 of a travelling wave tube of the present embodiment is made up of a collector electrode 2, heat conductive columnar ceramic elements 3, an outer enclosure 4 for maintaining vacuum and loss ceramic members 5 (see FIG. 1(*b*)) provided forwardly or rearwardly of the collector electrode 2.

The heat conductive columnar ceramic elements 3 are axially arranged (distributed) over the entire area (circumference) of an annular gap defined between the outer peripheral surface of the cylindrically-shaped collector electrode 2 and the inner peripheral surface of the cylindrically-shaped outer enclosure 4. The heat conductive columnar ceramic elements 3 are kept in contact with the collector electrode 2 by an outer flange thereof so that the ceramic elements 3 are not deflected at their axial ends. For improving voltage withstand characteristics, the inner peripheral surface of the outer enclosure 4 is spaced apart at the axial end portions from the heat conductive columnar ceramic element 3 by annular gaps 6, each of several mm. As a matter of course, the broader this gap, the lesser is the degree of concentration of the electrical field and the higher are voltage withstand characteristics.

Also, there is a small axial clearance between the columnar ceramic elements 3 and the rear loss ceramic member 5, which in turn is axially secured on a shoulder formed at the outer peripheral corner of the end plate of outer enclosure 4 leaving an axial clearance. The forward loss ceramic member 5 is axially and radially secured by an inward flange formed within the outer enclosure 4, while the diagonally opposite corner of the loss ceramic member 5 is axially secured by the outward flange at the forward end of the collector electrode 2. The rear loss ceramic member 5 is radially secured on a small annular rib or protrusions axially extending from the rear end of the collector electrode 2.

The cylindrically-shaped (annular ring) loss ceramic members 5 (see FIG. 1(*b*)) are arranged at both ends of the heat conductive columnar ceramic elements 3 so that a portion of the inner surface 5*b* (see FIG. 1(*b*)) of each member 5 (see FIG. 1(*b*)) is contacted with (secured by) the collector electrode 2 and the corner of the outer surface 5*a* (see FIG. 1(*b*)) of the loss ceramic member lying diagonally opposite to the contacted portion with the collector electrode 2 is contacted with (secured by) the outer enclosure.

The loss ceramic members 5 are of alumina material etc. coated on outer sides with a graphite layer of Aquadag E (trade name of Nihon Atisson K. K., a mixture of graphite and an aqueous binder).

After assembling the above structure of the entire collector, the resulting assembly is pressed from outside such as press-working to take heat conduction into account to deform the outer enclosure 4 to secure the various components in situ.

Figure 2:
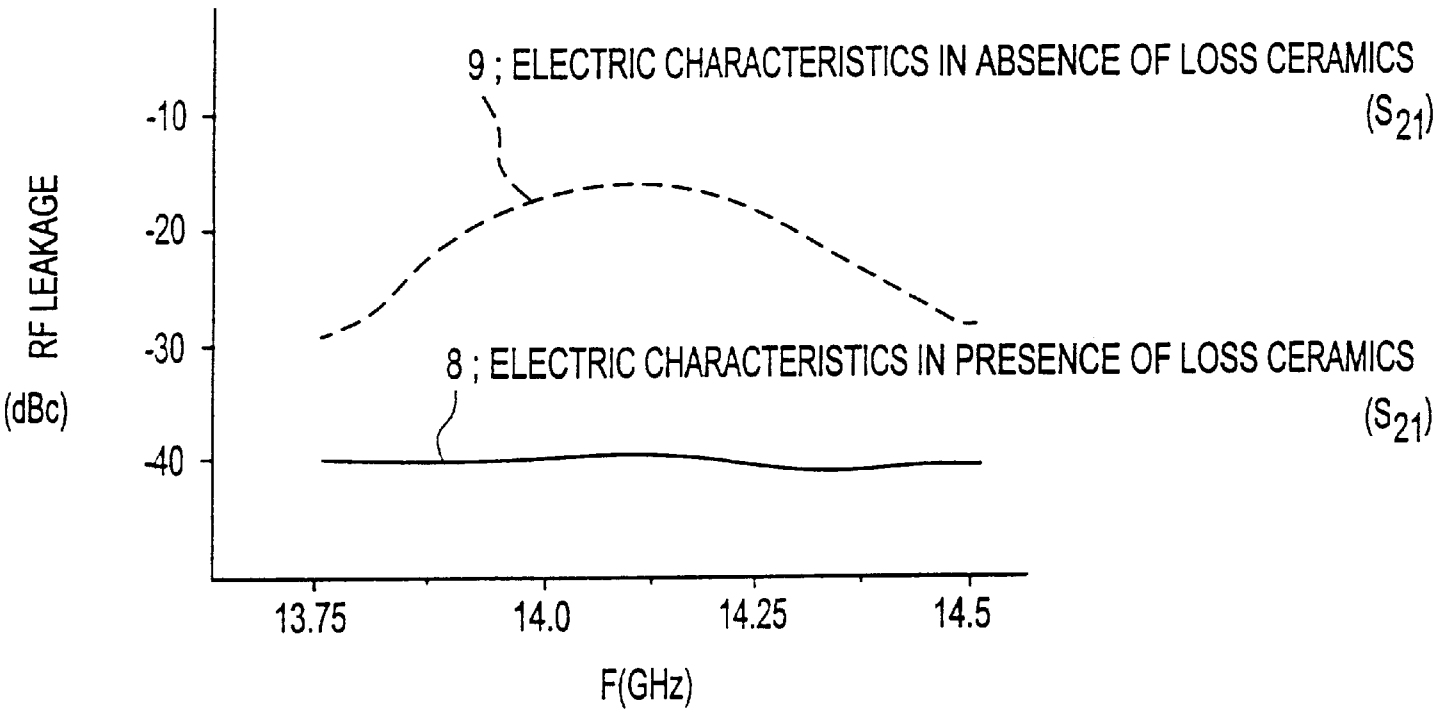
FIG. 2 shows transmission characteristics (S21) of the collector of a traveling wave tube according to the present invention and transmission characteristics (S21) in the absence of loss ceramic elements as a comparative embodiment.

FIG. 2 shows characteristics 8 as a transmission circuit (S21) in the TEM mode of the collector 1 of the structure of the preset embodiment. FIG. 2 shows, as a comparative embodiment, transmission characteristics 9 (S21) in the absence of the loss ceramic members 5.

As a measurement method, RF signals were entered at an electron beam incident end of the collector 1 and the signal level thereof was measured from a collector terminal 11 (see FIG. 1(*b*)) connecting to a collector lead wire 10 (see FIG. 1(*b*)). As may be seen from FIG. 2, the signal level was improved by approximately 20 dB in the present embodiment.

It may be surmised that the forward side loss ceramic member accounts for a loss of 10 dB, while the rear side loss ceramic member accounts for a loss of 10 dB, thus achieving improvement of 20 dB.

[Second Embodiment]

As a second embodiment, an internal insulation type two-staged collector is explained.

Figure 3A:
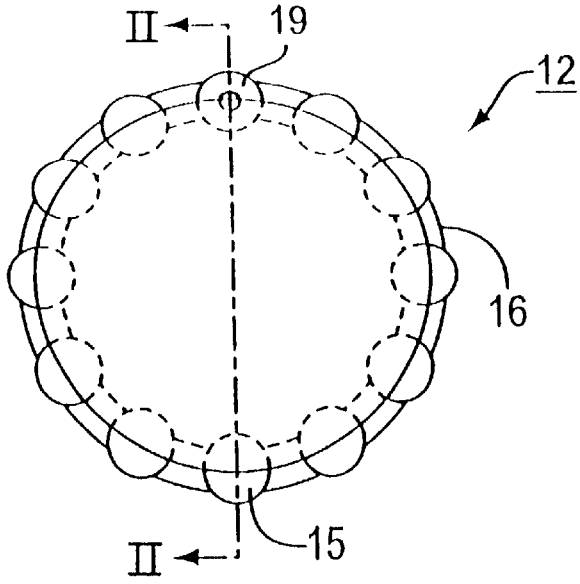
FIG. 3*a* is a transverse cross-sectional view of a second embodiment according to the present invention taken along line I—I of FIG. 3(*b*)
Figure 3B:
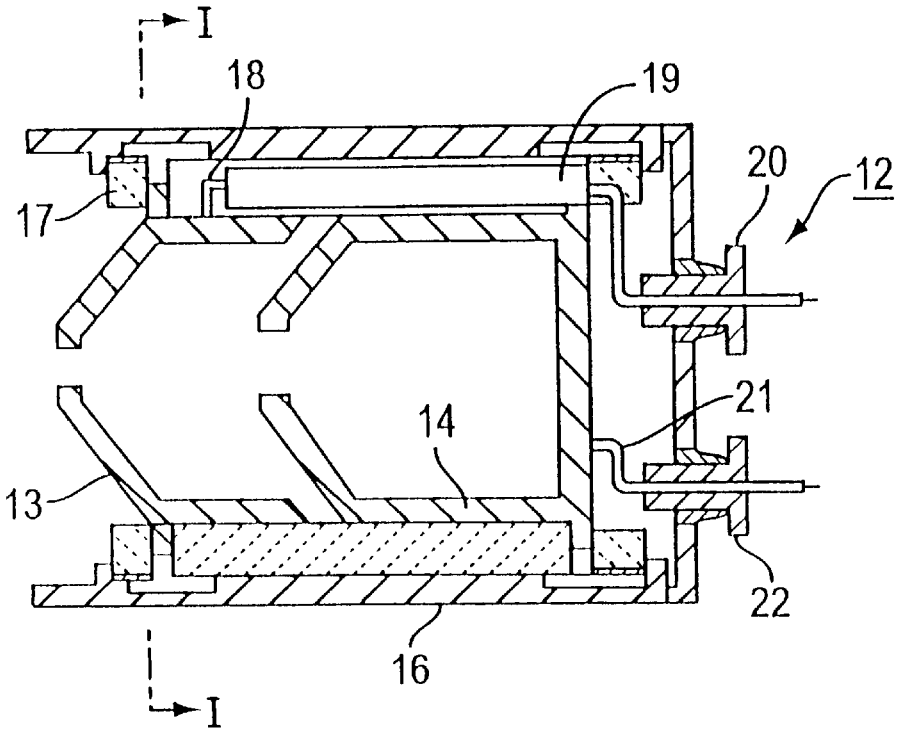
FIG. 3*b* is a longitudinal cross-sectional view taken along line II—II of FIG. 3*a*.

FIGS. 3(*a*) and 3(*b*) show the collector structure 12 of the second embodiment of the present invention. Specifically, FIG. 3*a* is a transverse cross-sectional view of the collector structure and FIG. 3*b* is a longitudinal cross-sectional view taken along line II—II thereof. Referring to FIGS. 3(*a*) and 3(*b*), the second embodiment of the present invention includes a first collector electrode 13 (see FIG. 3(*b*)), a second collector electrode 14 (see FIG. 3(*b*)), highly heat conductive columnar ceramic elements 15 (see FIG. 3(*a*)), an outer enclosure 16 for maintaining vacuum, loss ceramic members 17 (see FIG. 3(*b*)), arranged forwardly of the first collector electrode 13 and rearwardly of the second collector electrode 14, a first collector lead wire 18 (see FIG. 3(*b*)) extending from the first collector electrode 13 along the outer peripheral surface of the second collector electrode 14 to the rear side of the second collector via a cylindrically-shaped (hollow) ceramic element 19 for maintaining the insulation of the collector lead wire.

The first and second loss ceramic members 17 are axially secured between flanges formed on the collector electrodes 13, 14 and outer enclosure 16. Namely, the forward loss ceramic member 17 is secured between an inward protruding flange of the outer enclosure 16 and the outward protruding flange at the forward end of the first collector electrode 13. The rearward loss ceramic member is secured between the inward protruding flange of the outer enclosure 16 and the outward flange at the rear end of the second collector electrode 14. The columnar ceramic elements are axially secured between two outward flanges of the first and second collector electrodes 13, 14.

The first collector lead wire 18 is lead to outside vacuum via a first collector terminal 20 (see FIG. 3(*b*)). In addition, a second collector lead wire 21 (see FIG. 3(*b*)) is led to outside vacuum via a second collector terminal 22 (see FIG. 3(*b*)).

The first collector lead wire 18 is passed through the inside of cylindrically-shaped ceramic elements 19, placed in lieu of the heat conductive columnar ceramic elements 15, so as to be led to the rear side of the collector. The outer diameter of the cylindrically-shaped ceramic elements 19 is equal to or less than the diameter of the heat conductive columnar ceramic elements.

If the collector cooling method is of the conduction cooling type, the collector is placed on the opposite side of a portion of a base plate where the collector is contacted with a heat sink, that is on the side where heat dissipation is at the least level. If the collector cooling method is of the forced air cooling type or the water cooling type, the collector is placed on the side of the base plate carrying the collector where there is no air or water flow, that is towards the base plate carrying the collector. In short, the collector position is directly opposite to the conduction cooling position.

The present embodiment has an advantage that voltage withstand characteristics, vibration-resistance or impact-resistance and heat conductivity are equivalent to those of the first embodiment, even though the number of the collector stages is increased, thus assuring facilitated multi-stage collector designing.

It is noted that the Aquadag can be applied not only on the outer peripheral surfaces but also on the inner peripheral surfaces of the loss ceramic elements. Moreover, Aquadag can be applied to both surfaces of the loss ceramic elements if voltage withstand characteristics permit. Alternatively, Aquadag can be applied to a portion of the surfaces of the loss ceramic elements depending on the amount of RF leakage.

The meritorious effects of the present invention are summarized as follows.

According to the present invention, as described above, there may be provided an internal insulation type collector in which, by placing loss ceramic elements on the collector, RF leakage from the collector may be prevented and axial position setting can also be achieved while vibration-resistance and impact-resistance equivalent to those of the conventional system are maintained, and yet the voltage withstand characteristics can be improved.

Moreover, according to the present invention, high heat conductivity and voltage withstand characteristics can be maintained in achieving multi-stage collecting designing in consideration of arrangement of the collector lead wires.

The present invention may be used in combination with other structures and elements of the conventional devices other than the specific features of the present invention. Thus the entire disclosure relating to the prior art is also incorporated by reference in the disclosure of the present invention.

Further any arbitrary combination of the disclosed features and/or elements may be done within the gist of the present invention irrespective of the place of disclosure including the entire claims.

It should be noted that other objects of the present invention will become apparent in the entire disclosure and that modifications may be done without departing the gist and scope of the present invention as disclosed herein and appended herewith.

What is claimed is:

1. An internal insulation collector for a traveling wave tube having a structure in which a collector electrode is supported by a plurality of heat conductive columnar ceramic elements arranged between the collector electrode and an outer enclosure of the collector, and an inside of said collector electrode is arranged within an interior vacuum, wherein a loss ceramic member is arranged within said interior vacuum, said loss ceramic member being arranged between an outer surface of the collector electrode and an inner surface of the outer enclosure of the collector; and wherein a conductive loss layer is disposed in direct contact with, and covering, at least a portion of a surface of the loss ceramic member.

2. An internal insulation collector for a traveling wave tube having a structure in which a collector electrode is supported by a plurality of heat conductive columnar ceramic elements arranged between the collector electrode and an outer enclosure of the collector, said outer enclosure of the collector having an inner peripheral surface with annular gaps at axial end portions of said heat conductive columnar ceramic elements, wherein a portion of said collector electrode is illuminated with an electron beam;

an inside of said collector electrode is arranged within an interior vacuum; and insulating loss ceramic members, displaying high frequency loss, are arranged within said interior vacuum, said insulating loss ceramic members being arranged between an outer surface of said collector electrode not illuminated with the electron beam and a surface of said outer enclosure in contact with said columnar ceramic elements; and wherein at least one of said annular gaps between at least one axial end portion of the columnar ceramic elements and the outer enclosure improves voltage withstanding characteristics.

* * * * *

UNITED STATES PATENT AND TRADEMARK OFFICE

CERTIFICATE OF CORRECTION

Figure 4:
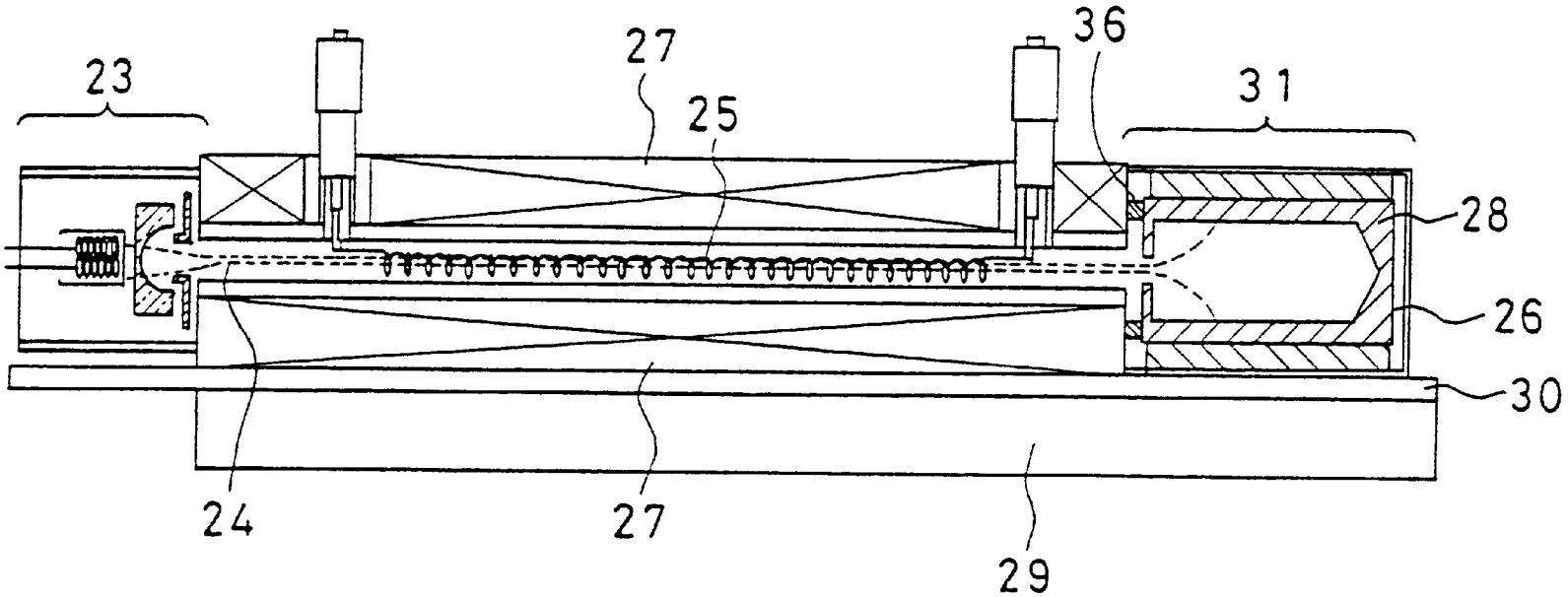
FIG. 4 PRIOR ART
FIG. 4 is a longitudinal cross-sectional view showing a structure of a conventional traveling wave tube of the conduction cooling type.
Figure 5B:
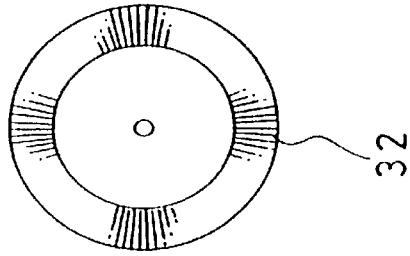
FIG. 5(b) PRIOR ART
FIG. 5(*a*) is a longitudinal cross-sectional view and FIG. 5(*b*) is a transverse view of FIG. 5(*a*) of a structure of a conventional traveling wave tube of the forced air cooling type.
Figure 5A:
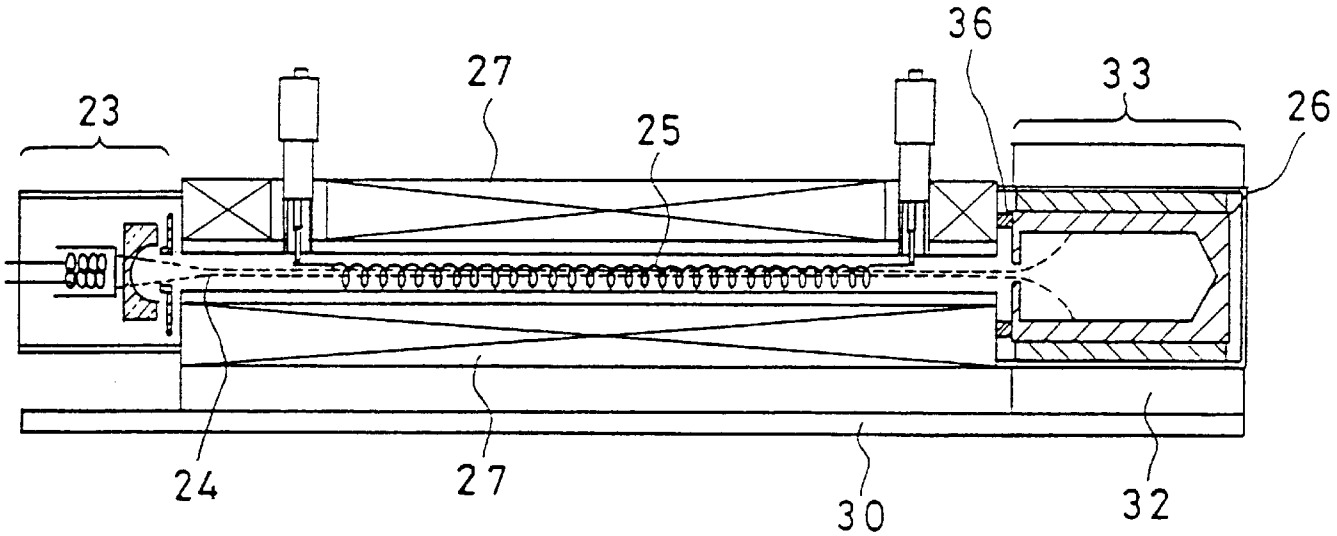
FIG. 5(a) PRIOR ART
Figure 6:
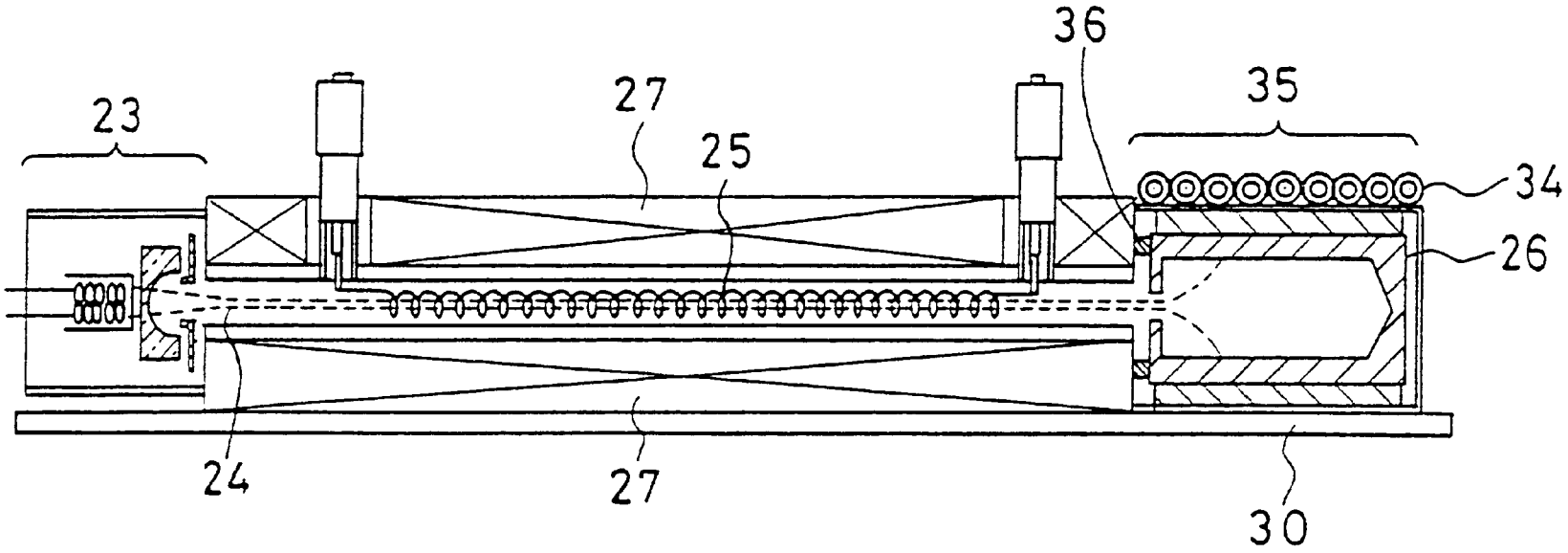
FIG. 6 PRIOR ART
FIG. 6 is a longitudinal cross-sectional view showing a structure of a conventional traveling wave tube of the water cooling type.
Figure 7:
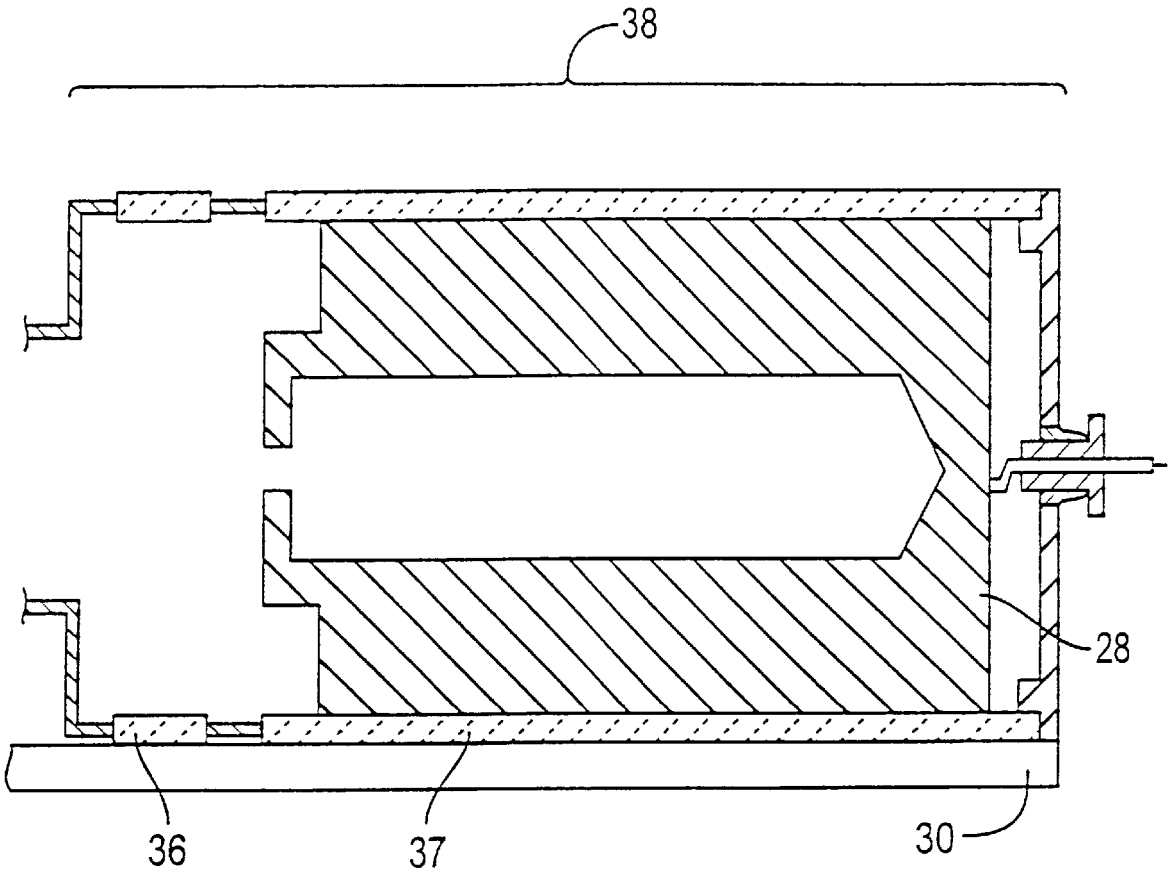
FIG. 7 (PRIOR ART)
FIG. 7 is a longitudinal cross-sectional view showing an example of a conventional collector.
Figure 8A:
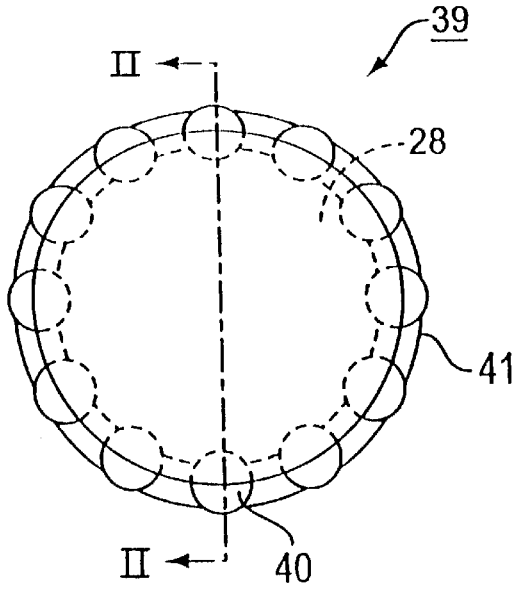
FIG. 8A (PRIOR ART)
FIG. 8*a* is a transverse cross-sectional view of another conventional collector taken along line I—I of FIG. 8*b*.
Figure 8B:
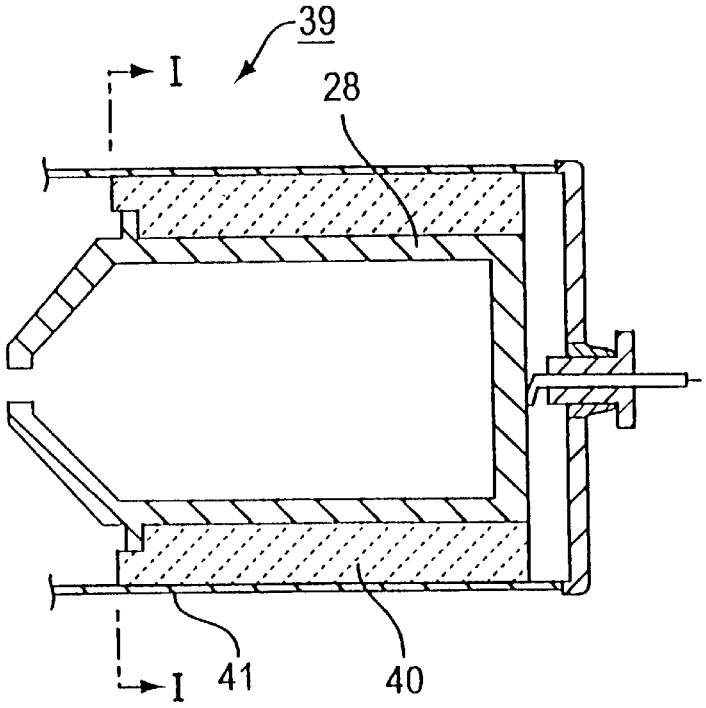
FIG. 8B (PRIOR ART)
FIG. 8*b* is a longitudinal cross-sectional view taken along line II—II of FIG. 8*a*.
Figure 9A:
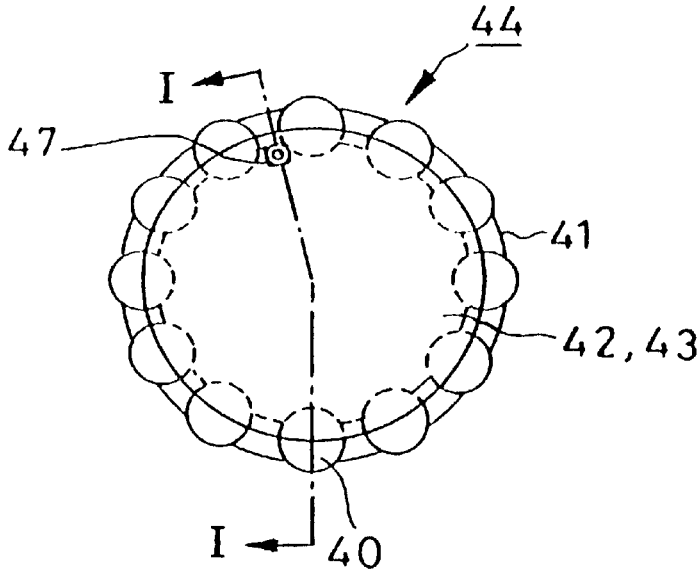
FIG. 9(a) PRIOR ART
FIG. 9*a* is a transverse cross-sectional view of a two-stage collector configuration and FIG. 9*b* is a longitudinal cross-sectional view taken along line I—I of FIG. 9(*a*).
Figure 9B:
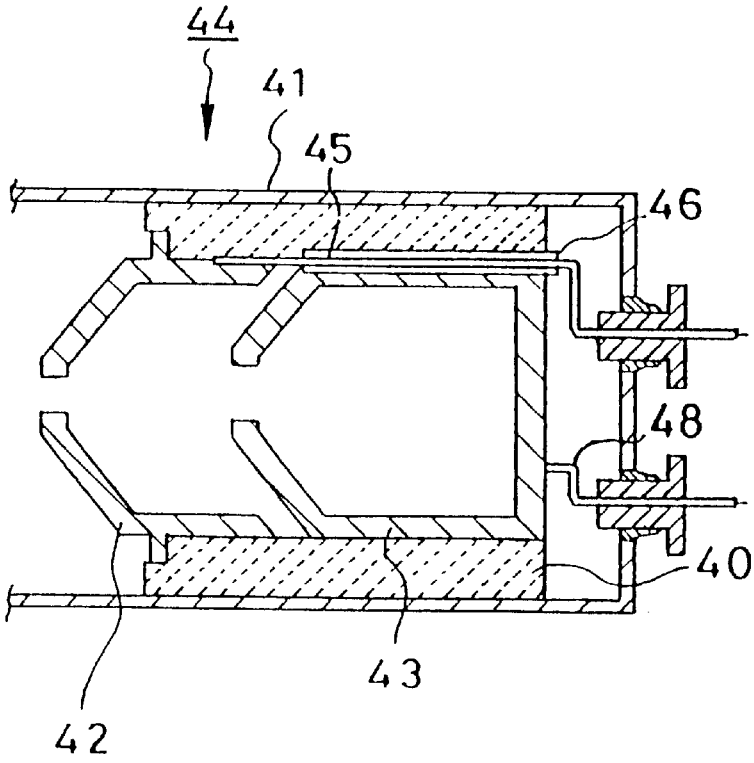
FIG. 9(b) PRIOR ART
Figure 10:
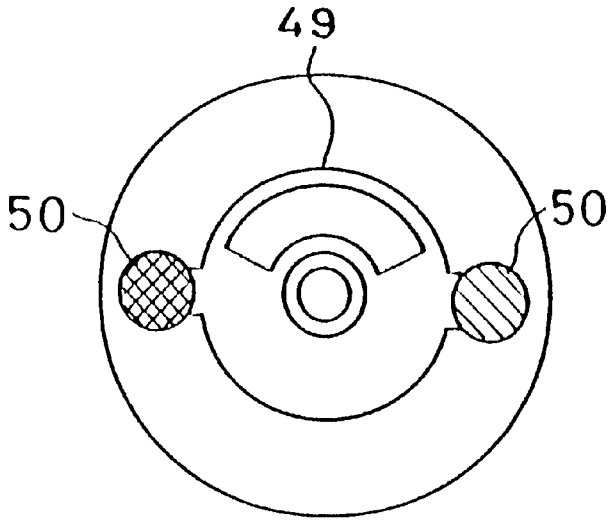
FIG. 10 PRIOR ART
FIG. 10 is a transverse cross-sectional view of a cavity employing a conventional loss ceramic element.

PATENT NO. : 6,670,760 B2
DATED : December 30, 2003
INVENTOR(S) : Wako Suzuki and Takeshi Nobe It is certified that error appears in the above-identified patent and that said Letters Patent is hereby corrected as shown below:

Column 1,
Lines 37-46, delete "For increasing the efficiency of the traveling wave tube, a method known as a collector potential lowering method is used. This method consists in progressively lowering method is used. This method consists in progressively lowering the potential applied across the collector electrode 28 (see FIG. 4) relative to the delay wave circuit 25 to lower the speed of the electron beam 24 colliding against the collector to decrease the energy generated in the collector electrode 28. To this end, there is provided a collector-insulating ceramic element 36 for maintain insulation between the collector 26 and the delay wave circuit 25 against high voltage."

After Line 65, insert -- For increasing the efficiency of the traveling wave tube, a method known as a collector potential lowering method is used. This method consists in progressively lowering method is used. This method consists in progressively lowering the potential applied across the collector electrode 28 (see FIG. 4) relative to the delay wave circuit 25 to lower the speed of the electron beam 24 colliding against the collector to decrease the energy generated in the collector electrode 28. To this end, there is provided a collector-insulating ceramic element 36 for maintain insulation between the collector 26 and the delay wave circuit 25 against high voltage. --

Column 6,
Line 31, after "binder)" insert -- A collector lead wire 10 is led outside of the vacuum via a collector terminal 11. --

Signed and Sealed this

Twenty-fifth Day of May, 2004

JON W. DUDAS
*Acting Director of the United States Patent and Trademark Office*